US005436217A

United States Patent [19]

Van Steen et al.

[11] Patent Number: 5,436,217

[45] Date of Patent: Jul. 25, 1995

[54] THERMAL DYE DIFFUSION TRANSFER METHOD AND DYE DONOR ELEMENT FOR USE THEREIN

[75] Inventors: Luc Van Steen, Antwerp; Emiel Verdonck, Berlaar; Geert Defieuw, Kessel, all of Belgium

[73] Assignee: AGFA-Gevaert, N.V., Mortsel, Belgium

[21] Appl. No.: 340,041

[22] Filed: Nov. 14, 1994

[30] Foreign Application Priority Data

Dec. 17, 1993 [EP] European Pat. Off. ..... 93203566

[51] Int. Cl.[6] ..... B41M 5/035; B41M 5/38

[52] U.S. Cl. ..... 503/227; 428/195; 428/206; 428/323; 428/331; 428/913; 428/914

[58] Field of Search ..... 8/471; 428/195, 206, 428/323, 331, 913, 914; 503/227

[56] References Cited

U.S. PATENT DOCUMENTS 4,541,830 9/1985 Hotta et al. ..... 8/471

*Primary Examiner*—B. Hamilton Hess

*Attorney, Agent, or Firm*—Brumbaugh, Graves, Donohue & Raymond

[57] ABSTRACT

The present invention provides a method for making an image comprising the steps of:

bringing a dye-layer comprised on the support of a dye donor element in face-to-face relationship with an image receiving layer comprised on a support of an image receiving element, said dye layer consisting of a repeating sequence of at least two dye frames each containing a dye dispersed or dissolved in a binder and, image-wise heating by means of thermal head each of said dye frames of said repeating sequence so as to cause image-wise transfer of dye from said dye layer to said image receiving layer characterised in that: said dye frames contain (a) particle(s) protruding from said dye layer, the last dye frame to be image-wise heated from said repeating sequence, containing said particle(s) in a reduced amount relative to the amount of said particle(s) in any of the other dye frames of said repeating sequence or alternatively said last dye frame being substantially free of said particle(s).

12 Claims, No Drawings

THERMAL DYE DIFFUSION TRANSFER METHOD AND DYE DONOR ELEMENT FOR USE THEREIN

DESCRIPTION

1. Field of the Invention

The present invention relates to dye donor elements for use according to thermal dye sublimation transfer. More in particular the present invention relates to a method and dye donor element for obtaining an improved image quality.

2. Background of the Invention

Thermal dye transfer methods include thermal dye sublimation transfer also called dye diffusion thermal transfer. This is a recording method in which a dye-donor element provided with a dye layer containing sublimating dyes having heat transferability is brought into contact with an image receiver sheet and selectively, in accordance with a pattern information signal, heated with a thermal printing head provided with a plurality of juxtaposed heat-generating resistors, whereby dye is transferred from the selectively heated regions of the dye-donor element to the image receiver sheet and forms a pattern thereon, the shape and density of which are in accordance with the pattern and intensity of heat applied to the dye-donor element. In order to obtain a full colour print, the image receiving sheet is printed three times with a yellow, magenta and cyan area of the dye-donor element. Usually, the three differently coloured areas are incorporated in one dye-donor element by applying subsequently a yellow, a magenta and a cyan dye area in separate regions of the dye-donor element. Moreover, when high densities of the printed image are required on transparencies, printing can be done two or three times with a dye-donor element with the same hue, such as mentioned in EP318946 and EP522207. This is especially usefull for printing high density black and white transparencies.

A dye-donor element for use according to thermal dye sublimation transfer usually comprises a very thin support e.g. a polyester support, one side of which is covered with a dye layer comprising the printing dyes in a form that can be released in varying amounts depending on how much heat is applied to the dye-donor element.

The dye in the dye layer is usually dissolved or dispersed in a binder. Known binder resins are cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, and cellulose triacetate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; copolymers of styrene and acrylonitrile; polysulfones; polyphenylene oxide; organosilicones such as polysiloxanes; epoxy resins and natural resins, such as gum arabic.

The dye layer comprising dye(s) dissolved or dispersed in a binder may be coated from a solution in appropriate solvents on the subbed support, but the known coating techniques are not quite adapted to the discontinuous coating of differently coloured dye areas on said very thin support. It is therefore customary, especially in large-scale manufacturing conditions, to print said dye layer on said support by printing techniques such as a gravure process.

Unfortunately, dye-donor elements comprising a dye layer containing high dye/binder ration have the disadvantage that—when stored or kept in rolled-up condition on reels or spools in cartridges—the side showing the dye/binder layer tends to stick to the contacting rear side of the dye-donor element. This sticking may result in tearing off of parts of the dye/binder layer.

This sticking is usually diminished by introducing spacer particles protruding from the surface of the dye layer of the dye-donor element, such as mentioned in EP 334323 and in EP 554583. These particles can be wax particles, having a melting point above 25° C. or can be solid particles, having no melting point. A problem arises when multiple printing is performed on a receiving element with dye-donor elements comprising high amounts of particles in the dye-layer. The wax particles are at least partially transferred to the receiving element and leave behind debris on the surface of the print. The solid particles, in contrast, remain to a great extent in the dye-donor element after printing, but leave small holes in the surface of the receiving element. Debris on the surface of the print leads to an .increasing degree of colour uniformity (coloured spots) in the black areas of the print, while small holes in the print lead to a decrease in dye transfer efficiency (lower density of the black areas of the print obtained by overprinting yellow, magenta and cyan dyes).

3. Summary of the Invention

It is therefore an object of the present invention to provide dye-donor elements not having the disadvantages mentioned above.

Further objects will become apparent from the description hereinafter.

According to the present invention, a dye-donor element for use in a multi-pass printing process is provided comprising on a support a dye layer consisting of a repeating sequence of at least two dye frames each containing a dye dispersed or dissolved in a binder, said dye frames containing (a) particle(s) protruding from said dye layer, the last dye frame to be printed from said repeating sequence containing said particle(S) in a reduced amount relative to the amount of said particle(s) in any of the other dye frames of said repeating sequence or alternatively said last dye frame being substantially free of particles protruding from said dye layer.

The present invention further provides a method for making an image comprising the steps of:

bringing a dye-layer provided on the support of a dye donor element in face-to-face relationship with an image receiving layer provided on a support of an image receiving element, said dye layer consisting of a repeating sequence of at least two dye frames each containing a dye dispersed or dissolved in a binder and, image-wise heating by means of thermal head each of said dye frames of said repeating sequence so as to cause image-wise transfer of dye from said dye layer to said image receiving layer characterised in that: said dye frames contain (a) particle(s) protruding from said dye layer, the last dye frame to be image-wise heated from said repeating sequence, containing said particle(s) in a reduced amount relative to the amount of said particle(s) in any of the other dye frames of said repeating sequence or alternatively said last dye frame being substantially free of said particle(s).

4. Detailed Description of the Invention

The particles used in accordance with the present invention are preferably uniformly distributed throughout the dye layer and have an average particle size exceeding the thickness of said dye layer so as to protrude from the surface of said layer. During the image-wise heating of the dye-donor element they may remain fixed in the dye layer or they may transfer to the image receiving sheet.

The particles used in accordance with the present invention preferably have an average particle size ranging from 0.3 to 40 μm, and more preferably from 1.5 to 8 μm. The particles that can be used may be thermomeltable particles, also called wax particles or they may be solid particles that do not melt during the transfer process.

Wax particles that can be used in accordance with the present invention can be any of the water-insoluble thermoplastic wax-like materials of the known six classes of waxes i.e. vegetable waxes, insect waxes, animal waxes, mineral waxes, petroleum waxes, synthetic waxes, as well as the water-insoluble wax-like components that occur individually in these waxes, more particularly long-chain hydrocarbons, saturated, unsaturated, branched, and unbranched fatty acids and alcohols, as well as the ethers and esters of aliphatic monohydric alcohols, with the proviso that the wax melts above 25° C.

Preferentially, the waxes used in accordance with the present invention are selected from the group consisting of polyolefin waxes, ester waxes, and amide waxes.

According to another more preferred embodiment the amide wax is an ethylene-bis-stearamide wax such as Ceridust 3910 (trade name) Hoechst, Germany.

For more details about waxes and wax-like thermoplastic materials there can be referred to "The Chemistry and Technology of Waxes", by A. H. Warth, 2nd Ed., 1956, Reinhold Publishing Corporation, New York, U.S.A. and to "Industrial Waxes" Vol. I, by H. Bennett, 1963, Chemical Publishing Company Inc., New York, U.S.A.

The wax used according to the present invention is preferably chemically inert towards the other ingredients of the dye layer. Preferably, it does not dissolve together with the binder and the dye(s) in the solvent or solvent mixture used to form a coating or printing composition that is applied to a support, which may have been provided first with an adhesive or subbing layer.

Sometimes it may be advantageous to combine two or more waxes.

Solid particles that can be used in connection with the present invention can be selected from the group of inorganic particles and crosslinked polymeric particles. As inorganic particles, silicates such as silica, talc, clay, quartz and carbonates such as e.g. calcium carbonate and dolomite can be used. As crosslinked polymeric particles, e.g. crosslinked polysiloxanes, polymethylsilylsesquioxane and crosslinked polymethylmethacrylate can be used. Among the solid particles, polymethylsilylsesquioxane is especially preferred. These polymethylsesquioxane particles are commercially available under the trade name Tospearl 108, Tospearl 120, Tospearl 130, Tospearl 145 (all from Toshiba Silicone) and KMP 590 (Shinetsu Silicone). These particles are monodisperse. The mean particle diameter is preferably between 0.7 and 7μm, more preferably between 1.5 and 5 μm. It can be advantageous to use a combination of wax particles with solid particles within one dye frame or to use different combinations in the different dye frames, with the proviso that the last dye frame to be printed from said sequence containing said particle(s) in a reduced amount relative to the amount of said particle(s) in any of the other dye frames of said sequence or alternatively that said last dye frame is substantially free of the particles protruding from said dye layer. By the 'amount of particles' is meant the total amount (weight) of particles per square meter of a dye frame of said dye-donor element. It is preferred to use a combination of solid particles and wax particles in the dye frame to be printed first and to use only solid particles in the remaining dye frames of the dye donor element. It is most preferred to use essentially no particles in the dye frame for the last printing pass. A combination of ethylene bisstearamide particles and polymethylsilylsesquioxane particles in the first frame, polymethylsilylsesquioxane particles in the second dye frame and essentially no particles in the third dye frame of a dye-donor element with three differently coloured dye frames (yellow, magenta and cyan) is especially preferred. Moreover the amount of ethylene bisstearamide in the first dye frame is preferably higher than the amount of polymethylsilylsesquioxane particles in the first dye frame of the dye-donor element.

According to another preferred embodiment, the dye donor element contains a repeating sequence of the three primary dye frames, i.e. yellow, magenta and cyan whereof only the first to be printed dye frame, generally the yellow dye frame of the sequence, contains thermomeltable particles protruding from the dye layer, the second (magenta) and third (cyan) dye frame to be printed being substantially free of thermomeltable particles protruding from the dye layer.

If it is only required to print black and white images it is advantageous to use a repeating sequence of two black colored dye frees wherein preferably only the first one of a sequence to be printed contains the particles protruding from said dye layer. It was found that the density of the black and white image can be improved in this way. The two black colored dye frames may contain the same dye mixture or a different dye mixture. Furthermore, the two dye frames are not required to be neutral or pure black.

The binder for the dye layer preferably comprises a copolymer comprising styrene units and acrylonitrile units, preferentially at least 60% by weight of styrene units and at least 25% by weight of acrylonitrile units binder. The binder copolymer may, of course, comprise other comonomers than styrene units and acrylonitrile units provided that a sufficient number of acrylonitrile units are present. Suitable other comonomers are e.g. butadiene, butyl acrylate, and methyl methacrylate. The binder copolymer preferably has a glass transition temperature of at least 50° C.

It is, of course, possible to use a mixture of the copolymer comprising styrene units and at least 15% by weight of acrylonitrile units with another binder known in the art, provided that said binder copolymer is present in an amount of at least 50% by weight of the total amount of binder. A binder that can be used advantageously in admixture with said binder copolymer is a toluene sulfonamide formaldehyde condensation product as described in the European patent application no. 92201621.7. Such condensation products are e.g. the commercially available Ketjenflex MH and Ketjenflex MS-80 (Akzo, The Netherlands).

The dye layer generally has a thickness of about 0.2 to 5.0 μm, preferably 0.4 to 2.0 μm, and the amount ratio of dye to binder generally ranges from 9:1 to 1:3 weight, preferably from 3:1 to 1:2 by weight.

Any dye or mixture of dyes can be used in the dye layer provided it is easily transferable to the image-receiving layer of the receiver sheet by the action of heat.

Typical and specific examples of dyes for use in thermal dye sublimation transfer have been described in e.g. EP 400,706, EP 209,990, EP 216,483, EP 218,397, EP 227,095, EP 227,096, EP 229,374, EP 235,939, EP 247,737, EP 257,577, EP 257,580, EP 258,856, EP 279,330, EP 279,467, EP 285,665, U.S. Pat. Nos. 4,743,582, 4,753,922, 4,753,923, 4,757,046, 4,769,360, 4,771,035, JP 84/78,894, JP 84/78,895, JP 84/78,896, JP 84/227,490, JP 84/227,948, JP 85/27,594, JP 85/30,391, JP 85/229,787, JP 85/229,789, JP 85/229,790, JP 85/229,791, JP 85/229,792, JP 85/229,793, JP 85/229,795, JP 86/268,493, JP 86/268,494, JP 85/268,495, and JP 86/284,489.

The coating composition for the dye layer may also contain other additives, such as curing agents, preservatives, dispersing agents, antistatic agents, defoaming agents, viscosity-controlling agents, these and other ingredients having been described more fully in EP 133,011, EP 133,012, EP 111,004, and EP 279,467.

Any material can be used as the support for the dye-donor element provided it is dimensionally stable and capable of withstanding the temperatures involved, up to 400° C. over a period of up to 20 ms, and is yet thin enough to transmit heat applied on one side through to the dye on the other side to effect transfer to the receiver sheet within such short periods, typically from 1 to 10 ms. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired.

The dye layer of the dye-donor element can be coated on the support or printed thereon by a printing technique such as a gravure process.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye/binder layer, so that the need for a separate adhesive or subbing layer is avoided. These particular hydrophilic polymers used in a single layer in the dye-donor element thus perform a dual function, hence are referred to as dye-barrier/subbing layers.

Preferably, the reverse side of the dye-donor element has been coated with a heat-resistant layer to prevent the printing head from sticking to the dye-donor element. Such a heat-resistant layer would comprise a lubricating material such as a surface-active agent, a liquid lubricant, a solid lubricant or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid exters. Suitable heat-resistant layers have been described in e.g. EP 138,483, EP 227,090, U.S. Pat. Nos. 4,567,113, 4,572,860, 4,717,711. Preferably the heat-resistant layer comprises a polycarbonate derived from a bis-(hydroxyphenyl)cycloalkane (diphenol), e.g. 1,1-bis-(4-hydroxyphenyl)-3,3,5-trimethylcyclohexane, as described in European patent application no. 91202071.6, as binder and a slipping agent comprising polydimethylsiloxane as lubricant in an amount of 0.1 to 10% by weight of the binder or binder mixture. Other binders for the heat-resistant layer that can be used advantageously for improving the non-stickiness of the dye-donor element in rolled-up state are i.a. cellulose acetate butyrate, cellulose acetate propionate, cellulose nitrate and polyvinylacetal. Suitable heat-resistant layers may also comprise cross-linked polymers for improving the non-stickiness of the dye-donor element in rolled-up state. The slipping agent may be coated in the form of a separate topcoat on top of said heat-resistant layer as described in the above-mentioned European patent application no. 91202071.6.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polystyrene-co-acrylonitrile, polycaprolactone, preferably polyvinyl chloride, or mixtures thereof. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, EP 227,094, and EP 228,066.

In order to improve the light-fastness and other stabilities of recorded images UV-absorbers, singlet oxygen quenchers such as HALS-compounds (Hindered Amine Light Stabilizers) and/or antioxidants can be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be incorporated in a separate layer on at least part of the dye layer and/or of the dye-image-receiving layer. Suitable releasing agents are solid waxes, fluorine- or phosphate-containing surface-active agents and silicone oils. Suitable releasing agents have been described in e.g. EP 133,012, JP 85/19,138, and EP 227,092.

The dye-donor elements according to the invention are used to form a dye transfer image, which process comprises placing a dye frame of the dye-donor element in face-to-face relation with the dye-image-receiving layer of the receiver sheet and image-wise heating from the back of the dye-donor element. The transfer of the dye is accomplished by heating for about several milliseconds at a temperature of 400° C. This process is repeated for the different dye frames of the dye donor element.

In addition to thermal heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat e.g. carbon black.

The following examples illustrate the invention in more detail without, however, limiting the scope thereof.

EXAMPLE 1

Wax particles in a 3-color dye-donor element.

Dye-donor elements were obtained by coating a polyethylene terephthalate support (5.7[[m) on one side with a subbing layer comprising a branched aromatic copolyester and a heat resistant layer based on a polycarbonate having the following repeating units and wherein the number of repeating units (n) is such that the polycarbonate has a relative viscosity of 1.3 as measured at 0.5% solution in dichloromethane.

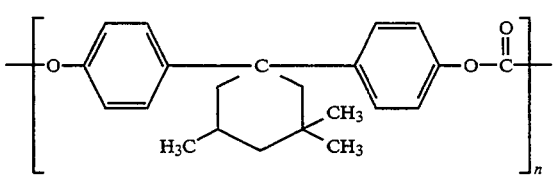

On top of said heat resistant layer, a topcoat comprising a polyether modified polydimethylsiloxane was applied in order to improve the transport properties of the dye-donor-element. On the other side of said dye-donor elements, a subbing layer comprising a branched aromatic copolyester was applied. On top of said subbing layer, a dye layer was coated from the dye coating mixtures as indicated in table I. The dye coating mixtures (DCM) were all applied from methylethylketone at a thickness of 10 μm (wet layer thickness). The amounts of particles added to some dye frames are indicated in table I as weight percentages in the dye coating mixtures.

The coating mixture for the yellow dye frames all contained 10% Luran 388S (BASF), 6% of dye 1 and 6% of dye 2 dye 1:

dye 1:

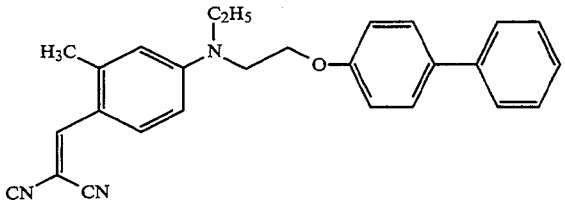

dye 2:

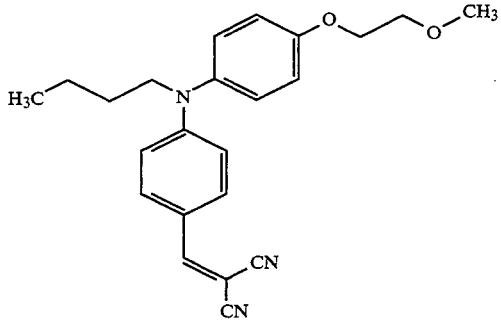

The coating mixture for the magenta dye frames all contained 10% Luran 388S (BASF), 9% of dye 3 and 2% of dye 4 dye 3:

dye 3:

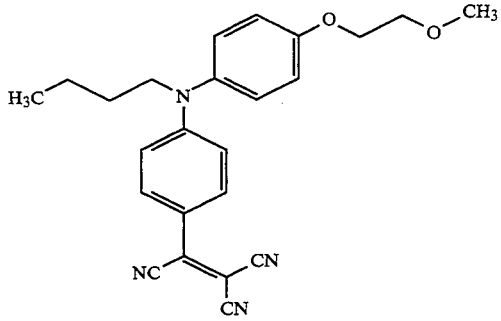

dye 4:

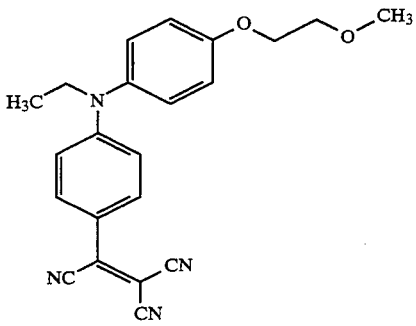

The coating mixture for the cyan dye frames all contained 10% of Luran 388 S (BASF), 8% of dye 5 and 4% of dye 6 dye 5:

dye 5:

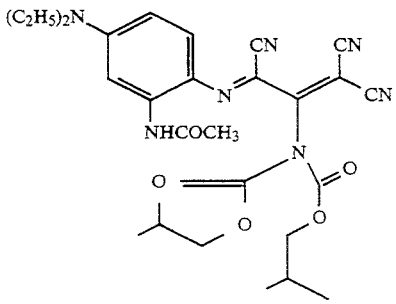

Image receiving sheets were prepared by coating a polyethylene terephthalate film support having a thickness of 175 μm with a dye-image-receiving layer from a solution in ethyl methyl ketone of 3.6 g/m$^2$ of poly (vinyl chloride/co-vinyl acetate/co-vinyl alcohol) (Vinylite VAGD supplied by Union Carbide), 0,336 g/m$^2$ of diisocyanate (Desmodur VL supplied by Bayer AG), and 0.2 g/m$^2$ of hydroxy-modified polydimethylsiloxan (Tegomer H SI 2111 supplied by Goldschmidt)

A yellow, a magenta and a cyan dye-frame of a dye donor element were printed in the order given on the image receiving sheets in a Mitsubishi CP100 printer. The image quality of the prints in the black image frames was determined visually (non-uniformity, coloured spots)

The following criteria were used

0=excellent image quality
1=very good image quality
2=good
3=moderate image quality
4=bad image quality

TABLE I

| Experiment | Particles in yellow frame | | Particles in magenta frame | | Particles in cyan frame | | Image quality (black frames) |
|---|---|---|---|---|---|---|---|
| | type | amount | type | amount | type | amount | |
| 1 (comparative) | I | 0.5 | I | 0.5 | I | 0.5 | 3 |
| 2 (invention) | I | 0.5 | I | 0.5 | — | — | 2–3 |
| 3 (invention) | I | 0.5 | — | — | — | — | 1 |
| 4 (invention) | I | 0.5 | I | 0.25 | I | 0.1 | 1–2 |
| 5 (comparative) | II | 0.5 | II | 0.5 | II | 0.5 | 3 |
| 6 (invention | II | 0.5 | — | — | — | — | 0 |
| 7 (comparative) | I<br>III | 0.5<br>0.5 | I<br>III | 0.5<br>0.5 | I<br>III | 0.5<br>0.5 | 4 |
| 8 (invention) | I<br>III | 0.5<br>0.5 | III<br>— | 0.5<br>— | — | — | 0 |
| 9 (invention) | I<br>III | 0.075<br>0.5 | III<br>— | 0.5<br>— | —<br>— | —<br>— | 0 |

I: Ceridust 3910, micronised ethylene bisstearamide available from Hoechts AG
II: Ball mill dispersion of zinc stearate with an average particle size of 3–4 μm
III: Tospearl 120, polymethylsilylsesquioxane particles of 2 μm (monodisperse) available from Toshiba Silicone.

dye 6:

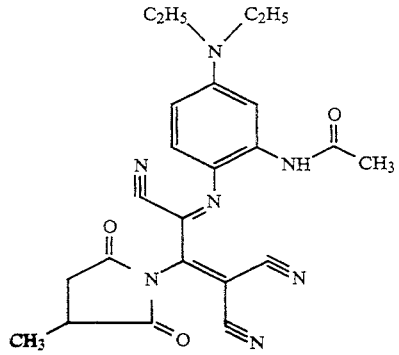

It can be seen from table I that the image quality of the prints made with the dye-donor elements of the present invention, comprising in the last dye frame to be printed (cyan) a lower amount of particles than any of the other dye frames (yellow, magenta), is excellent as compared to the comparative examples. The image quality of the prints in the black areas is bad or moderate due to the presence of high amounts of wax particles in the last dye frame. It can further be seen from samples 8 and 9 compared with sample 7 that the best results are obtained when only the first dye frame contains thermomeltable particles (wax particles).

EXAMPLE 2

Solid particles in a 3-color dye-donor element.

Dye donor elements were prepared as described in example 1, except that only solid particles were used (see table II). The dye-donor elements were printed on image receiving sheets as described in example I. The dye transfer efficiency was evaluated by measuring the maximal visual density in the black image areas using a Macbeth densitometer TR924 equipped with status A filters.

TABLE II

| Experiment | Particles in yellow frame | | Particles in magenta frame | | Particles in cyan frame | | Visual density |
|---|---|---|---|---|---|---|---|
| | type | % | type | % | type | % | |
| 1 | III | 0.5 | III | 0.5 | III | 0.5 | 1.81 |

TABLE II-continued

| Experiment | Particles in yellow frame type | Particles in yellow frame % | Particles in magenta frame type | Particles in magenta frame % | Particles in cyan frame type | Particles in cyan frame % | Visual density |
|---|---|---|---|---|---|---|---|
| (comparative) 2 (invention) | III | 0.5 | III | 0.5 | — | — | 1.88 |
| 3 (invention) | III | 0.5 | — | — | — | — | 1.94 |

Table II illustrates that the prints, obtained with a dye donor element having a lower amount of particles in the last dye frame (cyan), have a higher visual density, although the same amount of dye per $M^2$ was used in the three dye frames.

EXAMPLE 3

Black dye donor elements

Black dye donor elements with two black dye frames were prepared similar to the procedure as described in example 1, except that 8% of Luran 388S (BASF) as a binder and the following dye mixture was used: 4.5% of dye 7, 5% of dye 8, 2% of dye 9, 2% of dye 10 and 4% of dye 1 dye 7:

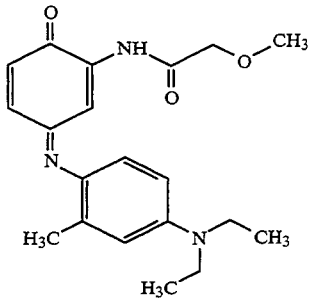

dye 8:

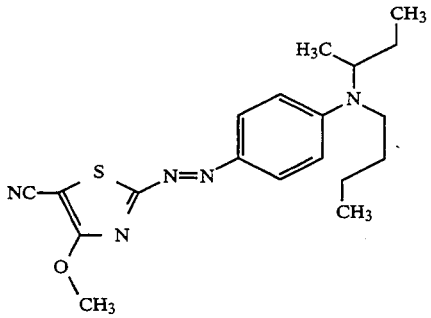

dye 9:

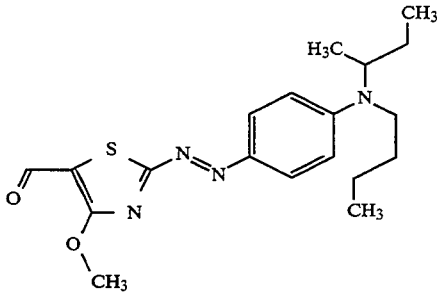

dye 10:

-continued

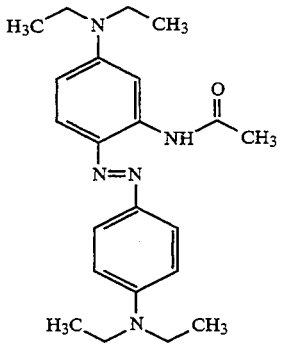

The type and amount of particles used in the two dye frames of the dye donor elements are described in table III. The two dye frames of the dye donor elements were printed subsequently (two printing passes) on image receiving sheets as described in example 1. The dye transfer efficiency was evaluated as in example 2.

TABLE III

| Experiment | Particles in the first black frame type | Particles in the first black frame % | Particles in the second black frame type | Particles in the second black frame % | Visual density |
|---|---|---|---|---|---|
| 1 (comparative) | IV | 0.3 | IV | 0.3 | 2.56 |
| 2 (invention) | IV | 0.3 | — | — | 2.66 |

IV: Tospearl 145, polymethylsilylsesquioxane particles of 4.5 μm (monodisperse), available from Toshiba Silicone.

It can be observed from table III that the dye donor element of the present invention have a higher dye transfer efficiency than the comparative example.

We claim:

1. A dye-donor element for use in a multi-pass printing process comprising on a support a dye layer consisting of a repeating sequence of at least two dye frames each containing a dye dispersed or dissolved in a binder, said dye frames containing (a) particle(s) protruding from said dye layer, the last dye frame to be printed from said repeating sequence containing said particle(s) in a reduced amount relative to the amount of said particle(s) in any of the other dye frames of said repeating sequence or alternatively said last dye frame being substantially free of particles protruding from said dye layer.

2. A dye donor element according to claim 1 wherein said dye layer contains as particles protruding from said dye layer, thermomeltable particles or a mixture of thermo-meltable particles and particles not being thermo-meltable.

3. A dye donor element according to claim 2 wherein said dye layer consists of a repeating sequence of three primary dye frames yellow, magenta and cyan and wherein said thermo-meltable particles are only present in the first primary dye frame of said repeating sequence.

4. A dye donor element according to claim 3 wherein said first primary dye frame contains a mixture of polymethylsilylsesquioxane and ethylene bisstearamide, the second primary dye frame containing only polymethylsilylsesquioxane as protruding particle and the third primary dye frame being substantially free of particles protruding from said dye layer.

5. A dye donor element according to claim 1 wherein said particles are selected from the group consisting of polymethylsilylsesquioxane, ethylene bisstearamide and mixtures thereof.

6. A dye donor element according to claim 1 wherein said dye layer consists of a repeating sequence of two black colored dye frames.

7. A method for making an image comprising the steps of:

bringing a dye-layer provided on the support of a dye donor element in face-to-face relationship with an image receiving layer provided on a support of an image receiving element, said dye layer consisting of a repeating sequence of at least two dye frames each containing a dye dispersed or dissolved in a binder and, image-wise heating by means of thermal head each of said dye frames of said repeating sequence so as to cause image-wise transfer of dye from said dye layer to said image receiving layer characterised in that: said dye frames contain (a) particle(s) protruding from said dye layer, the last dye frame to be image-wise heated from said repeating sequence, containing said particle(s) in a reduced amount relative to the amount of said particle(s) in any of the other dye frames of said repeating sequence or alternatively said last dye frame being substantially free of said particle(s).

8. A method according to claim 7 wherein said dye layer contains as particles protruding from said dye layer, thermo-meltable particles or a mixture of thermo-meltable particles and particles not being thermo-meltable.

9. A method according to claim 8 wherein said dye layer consists of a repeating sequence of three primary dye frames yellow, magenta and cyan and wherein said thermo-meltable particles are only present in the first primary dye frame of said repeating sequence.

10. A method according to claim 7 wherein said particles are selected from the group consisting of polymethylsilylsesquioxane, ethylene bisstearamide and mixtures thereof.

11. A method according to claim 9 wherein said first primary dye frame contains a mixture of polymethylsilylsesquioxane and ethylene bisstearamide, the second primary dye frame containing only polymethylsilylsesquioxane as protruding particle and the third primary dye frame being substantially free of particles protruding from said dye layer.

12. A method according to claim 7 wherein said dye layer consists of a repeating sequence of two black colored dye frames.

* * * * *

UNITED STATES PATENT AND TRADEMARK OFFICE

CERTIFICATE OF CORRECTION

PATENT NO. : 5,436,217

DATED : July 25, 1995

INVENTOR(S) : Van Steen et al.

It is certified that error appears in the above-indentified patent and that said Letters Patent is hereby corrected as shown below:

Column 4, line 44 "frees" should read --frames--;

Column 7, line 42, "(5.7[[m)" should read --(5.7μm)--;

Column 8, line 5, "dye 2 dye 1" should read --dye 2--;

Column 8, line 34, "dye 4 dye 3" should read --dye 4--;

Column 8, line 68, "dye 6 dye 5" should read --dye 6--;

Column 9, line 61, "0,336" should read --0.336--.

Signed and Sealed this

Fourth Day of June, 1996

Bruce Lehman

*Attest:*

BRUCE LEHMAN

*Attesting Officer*

*Commissioner of Patents and Trademarks*